US007154367B1

(12) United States Patent
Chen

(10) Patent No.: US 7,154,367 B1
(45) Date of Patent: Dec. 26, 2006

(54) WIRE WOUND CHOKE COIL

(76) Inventor: Hsin-Chen Chen, 7F., No.16-6, Fuchou St., Taipei (TW)

( * ) Notice: Subject to any disclaimer, the term of this patent is extended or adjusted under 35 U.S.C. 154(b) by 0 days.

(21) Appl. No.: 11/144,685

(22) Filed: Jun. 6, 2005

(51) Int. Cl.
*H01F 5/00* (2006.01)

(52) U.S. Cl. ..... 336/200

(58) Field of Classification Search ..... 336/65, 336/83, 192, 200, 233
See application file for complete search history.

(56) References Cited

U.S. PATENT DOCUMENTS 3,448,421 A * 6/1969 Berg et al. ..... 336/84 R
3,824,518 A * 7/1974 Slenker ..... 336/96
4,866,573 A * 9/1989 Bernstein ..... 361/782
5,014,071 A * 5/1991 King ..... 343/788
6,205,646 B1 * 3/2001 Thibado ..... 29/602.1
6,531,944 B1 * 3/2003 Maruyama ..... 336/192

* cited by examiner

*Primary Examiner*—Tuyen T Nguyen

(57) ABSTRACT

A wire wound choke coil uses a metallic conductor to form a coil. The surface of the conductor is pre-plated with metallic material such as gold, silver, nickel, tin or others before covered with an insulation film on it so as to form a plated conductor enclosed with an insulated film. After forming a coil, its two terminals (electrodes) can be directly soldered to a circuit board without extra treatment after stripping off the outer film. The coil leads at two terminals are left a length slightly less than one turn so as to save the time for stripping longer insulation. After that a core with two chamfered or filleted ends, and whose outer diameter being slightly larger than the inner diameter of the coil is inserted longitudinally into the hollow cavity of the coil. By so, the core can be forcibly embraced by the resiliency of the coil without worry of parting accidentally. Besides, both end surfaces of the core are plated so that it can be easily soldered onto the circuit board.

17 Claims, 16 Drawing Sheets

WIRE WOUND CHOKE COIL

BACKROUND OF THE INVENTION

1. Filed of the invention

The present invention relates to a wire wound choke coil, and more particularly, to a wire wound choke coil capable of shortening the fabrication process so as to save production cost thereby facilitating mass production.

2. Description of the Prior Art

The terminals of a conventional wire wound choke coil or air core coil are usually constructed straightly parallel with each other or flexed in a straight angle so as to connect with the electrical circuit board by soldering in the form of Dip type or SMD (Surface Mount Device) type. The overall structure of a choke coil is made of winding an insulated conductor directly around a core and then fixed with a binder. However, a choke coil or an air core coil constructed as such is no more able to meet with the requirement. Today's calling for compactness is sized by reason unabling to shorten its fabrication process by automation, therefore, lowering the production cost by mass production is quite impossible.

FIG. 1(*a*), (*b*) show a conventional wire wound choke coil 7. As its size is rather bulky, an insulated conductor 71 can be directly wound on a core 72 and then stuck to it with a binder that can avoid parting of the coil 71. The two terminals (electrodes) 711 of the coil can only be formed into Dip type. In case the choke coil 7 is small sized as 0805, 0603, 0402 (EIA) which being too small to wind the insulated conductor 71 around the core 72, the Dip type is practically difficult.

FIG. 2(*a*), (*b*) and FIG. 3(*a*), (*b*) show existing compact SMD air core coils 8, 9, the sizes are made as small as 0805, 0603, 0402 (EIA), when inserting the core into a coil 8, 9 for assembling a choke coil, two terminals (electrodes) for surface mount will be distorted thereby unabling to keep in parallel to the electrical circuit board for soldering. If the core has an outer diameter smaller than the inner diameter of the coils 8, 9, due to too small in size the work will be so hard that the binder applied after insertion of the core might diffuse and leak so as to decrease the conductance of the terminals which being contaminated by the binder.

For these defects noticeable on the prior art, an improvement is seriously required.

The inventor has plunged in this matter for years to studying and improving these defects and come up with a novel wire wound choke coil as provided in this invention to eliminate the defects mentioned above.

SUMMARY OF THE INVENTION

The present invention is to provide a wire wound choke coil capable of shortening fabrication process so as to save production cost thereby benefiting the mass production.

Another, the present invention is to use an insulated conductor, whose conductor being pre-plated with a layer of metal, to form a choke coil so that its two terminals can be directly connected to an electrical circuit board without soldering or plating after stripping off the insulation film.

To achieve the objects a metallic conductor is used to form a coil. The surface of the conductor is pre-plated with metallic material such as gold, silver, nickel, or tin before covered with an insulation layer on it so as to form a plated conductor enclosed with an insulated film. After stripping off the insulation film on both end and forming a coil, its two terminals (electrodes) can be directly soldered to an electrical circuit board without extra soldering and plating process. The coil leads at two terminals (electrodes) are left with a length slightly less than one turn to save the time for stripping longer insulation film. After that a core with two chamfered or filleted ends, and whose outer diameter being slightly larger than the inner diameter of the coil, is inserted longitudinally into the hollow cavity of the coil without worry of parting accidentally. Besides, both end surfaces of the core are plated so that it can be easily soldered onto the circuit board.

These features and advantages of the present invention will be fully understood and appreciated from the following detailed description of the accompanying Drawings.

DETAILED DESCRIPTION OF THE PREFFERED EMBODIMENTS

Figure 1:
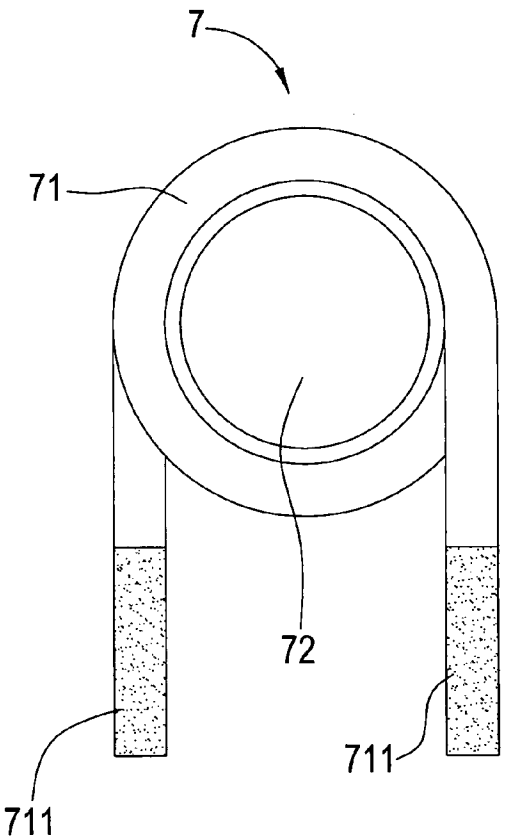
FIGS. 1 (*a*), (*b*) are schematic views of a conventional choke coil.
Figure 1:
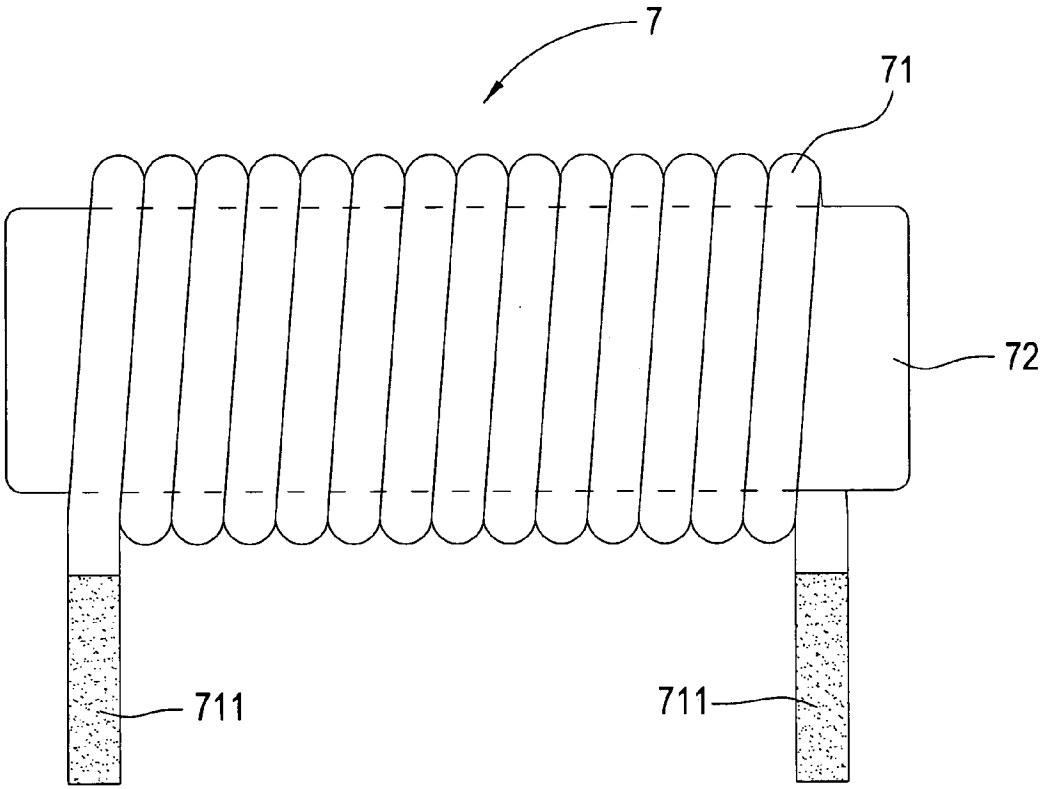
Figure 2:
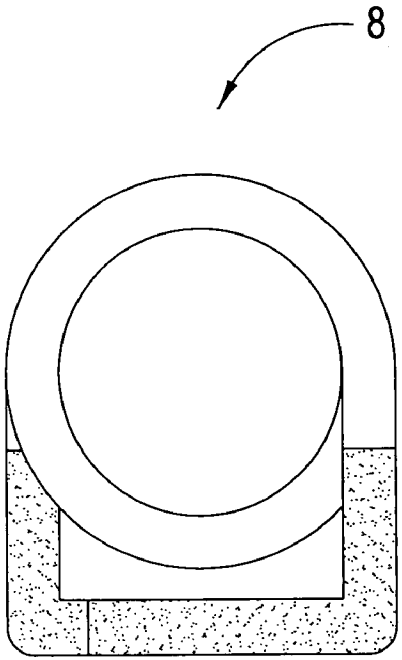
FIGS. 2 (*a*), (*b*) are schematic views of a conventional air core coil.
Figure 2:
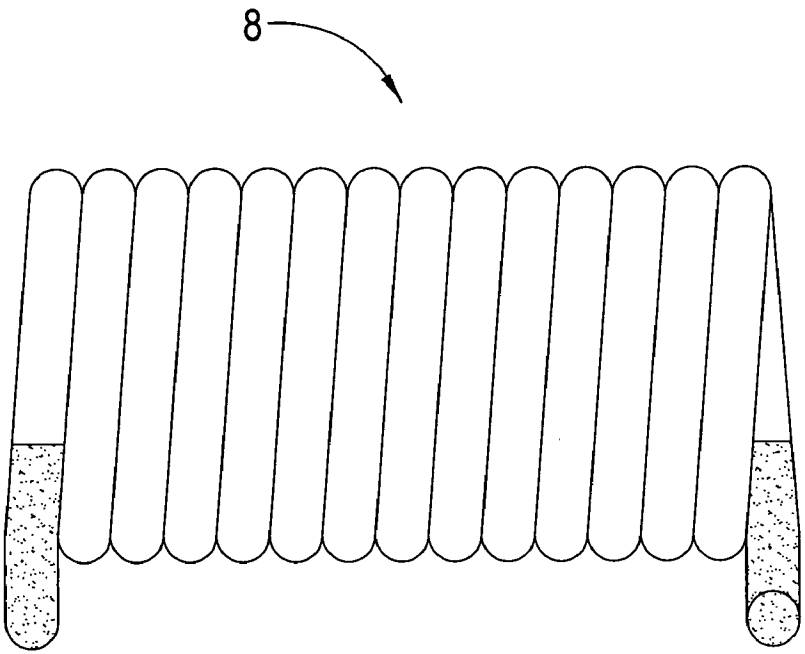
Figure 3:
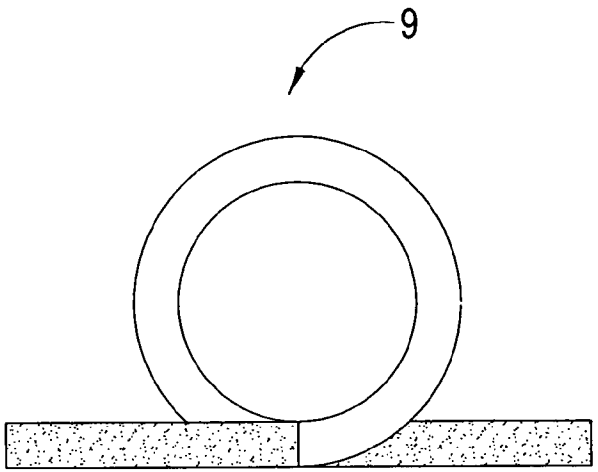
FIGS. 3 (*a*), (*b*) are schematic views of another conventional air core coil.
Figure 3:
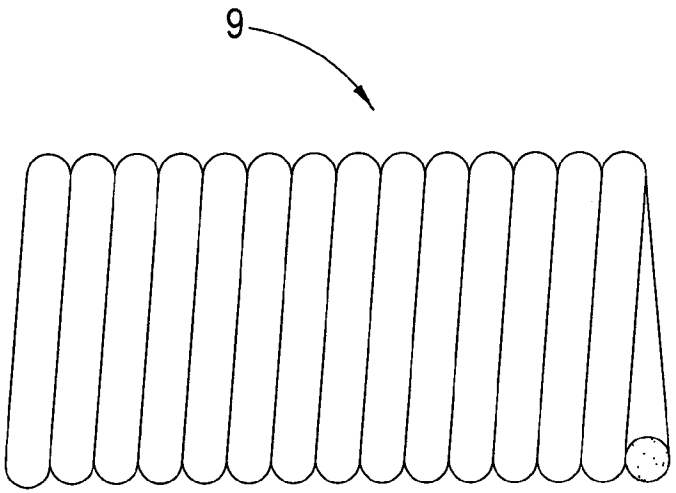
Figure 4:
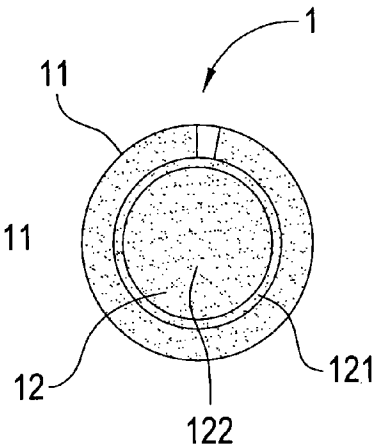
FIGS. 4 (*a*), (*b*), (*c*) are perspective views of the wire wound choke coil according to the present invention.
Figure 4:
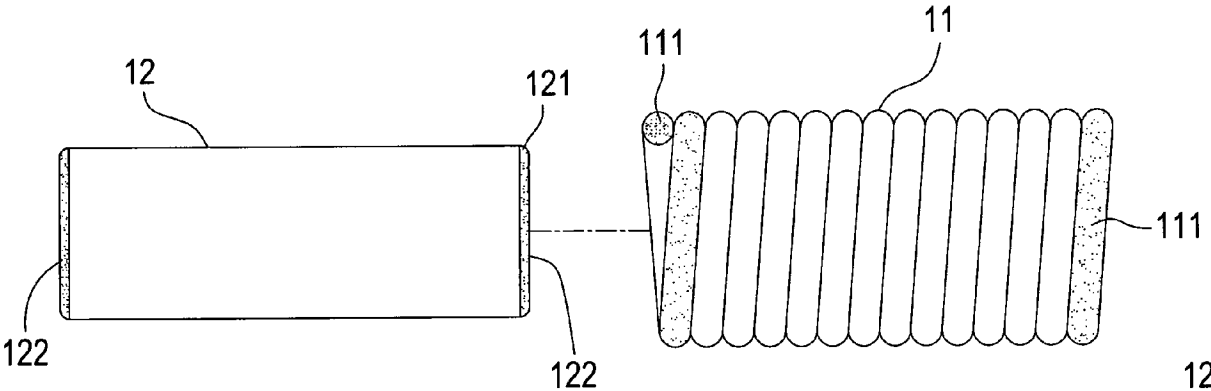
Figure 4:
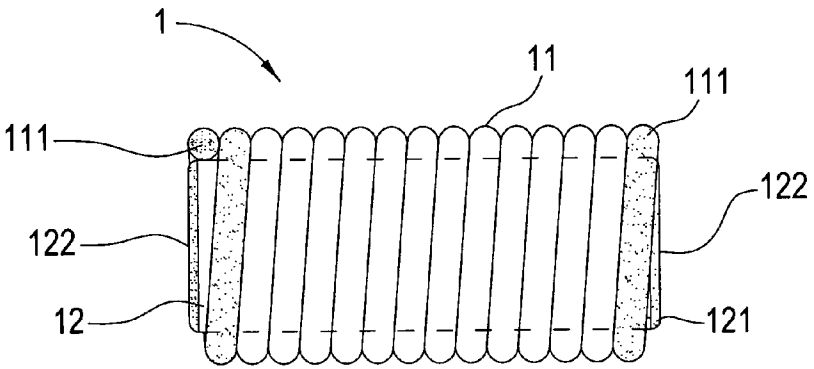

Referring to FIGS. 4 (*a*), (*b*), (*c*), the wire wound choke coil 1 of the present invention comprises a coil 11 and a core 12.

The coil 11 is made of an insulated conductor spirally wound closely or loosely with a predetermined number of turns and diameter, and extending both terminals 111 (electrodes) with a length slightly less than one turn (see FIG. 4(*b*)). The conductor used for the coil 11 is pre-plated with a layer of metals selected one from the group gold, silver, tin, nickel or others before covering with an insulation film, so as to form two solderable terminals 111 directly and quickly connect to an electrical circuit board after stripping off the insulation film without any other treatment. The size of the conductor is selective according to the requirement. Besides, the coil 11 can be wound of a twisted insulated conductors (Litz wire), or if required, formed into a multi-layer coil by repeatedly winding back and forth with an insulated conductor, or with different kind and sized insulated conductors.

The core 12 with two chamfered or filleted end surfaces 121 at both ends, and with an outer diameter slightly larger than the inner diameter of the coil 11, is easily inserted longitudinally into the inner hollow cavity of the coil 11 and forcibly embraced by the coil 11 by its resiliency without worry of parting. The two end surfaces of the core 12 can be provided with a plated layer 122. The core 12 is formed of ferrite, ceramic, glass or others.

Besides, the both terminals 111 (electrodes) and the plated layer 122 on both end surfaces of the core 12 are provided with solder plating to form a united terminal electrode so as to facilitate an electrical connection with the circuit board.

Figure 5:
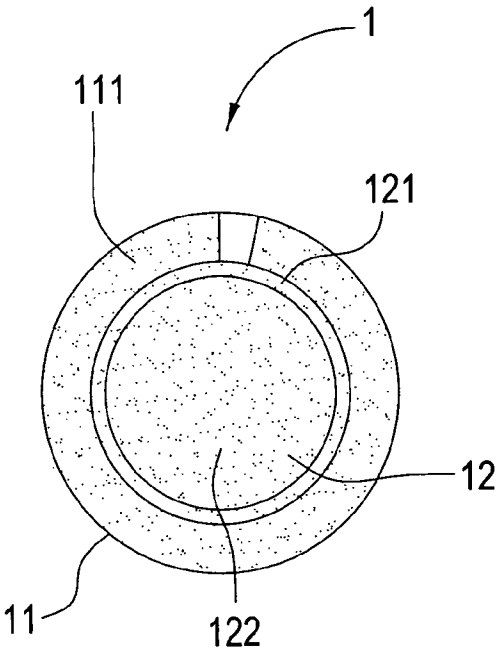
FIGS. 5 (*a*), (*b*) are perspective views of another wire wound choke coil according to the present invention.
Figure 5:
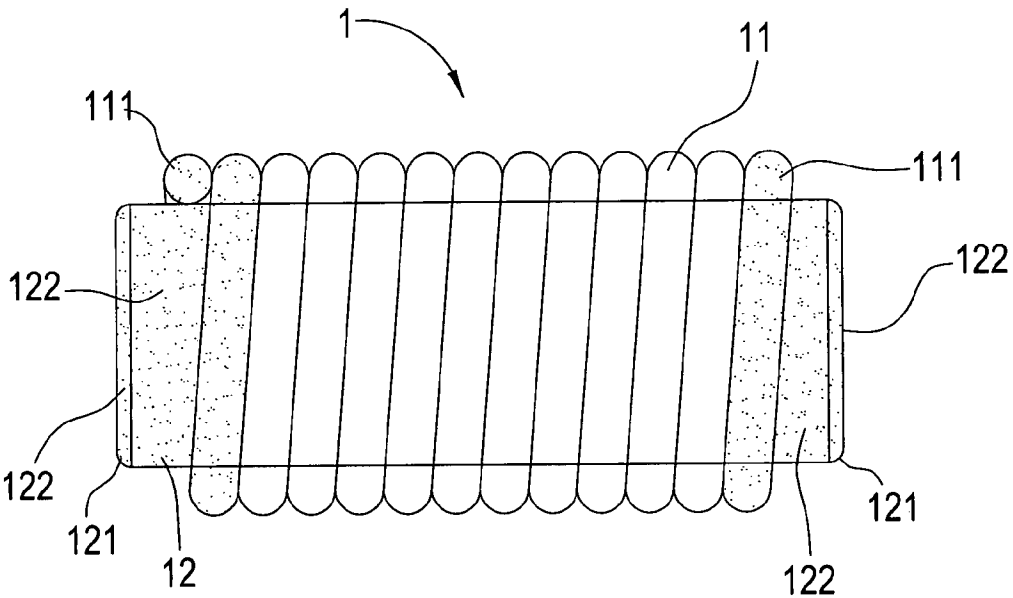

Referring to FIGS. 5 (*a*), (*b*), the length of the core 12 is not necessarily be equal to that of the coil 11, if the former is slightly longer than the latter, and emerges out of the latter, the emerged part can be provided with the plated layer 122 so as to facilitate soldering the core 12 firmly on the circuit board.

Figure 6:
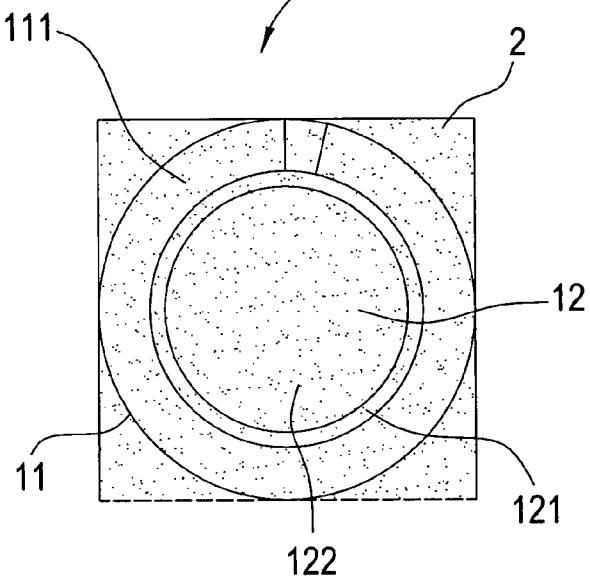
FIGS. 6 (*a*), (*b*) are perspective views in which an improvement is made to the wire wound choke coil shown in FIG. 5.
Figure 6:
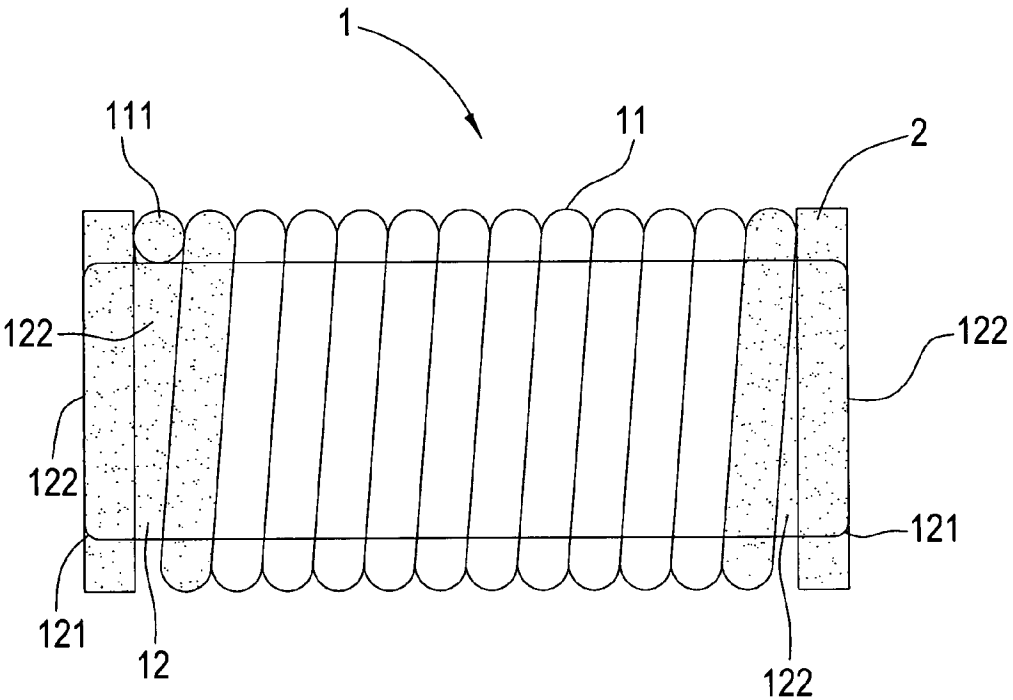

Referring to FIGS. 6 (*a*), (*b*), for preventing the choke coil 1 of FIGS. 5 (*a*), (*b*) to move at random during soldering on the circuit board, a pre-plated square hollow metal conductor 2 can be employed to shackle the emerged part of the core 12 so as to perform soldering work stably.

Figure 7:
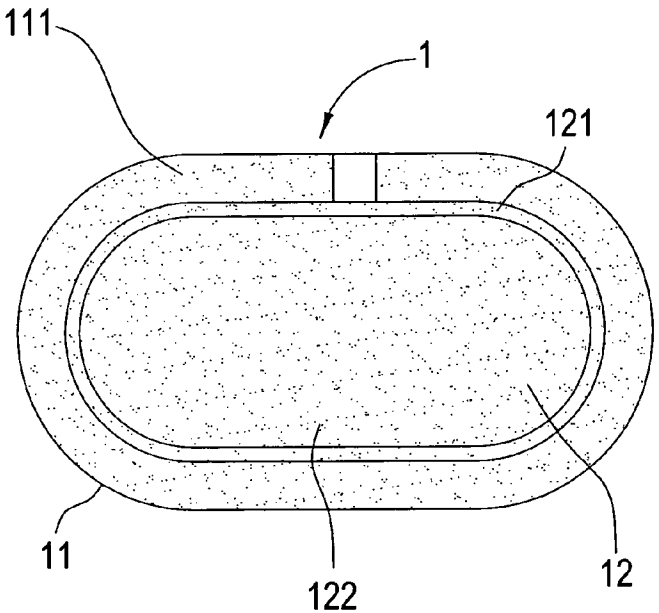
FIGS. 7 (*a*), (*b*) are schematic views of the wire wound choke coil according to the present invention in which the coil and core are configurated in an elliptical cross section.
Figure 7:
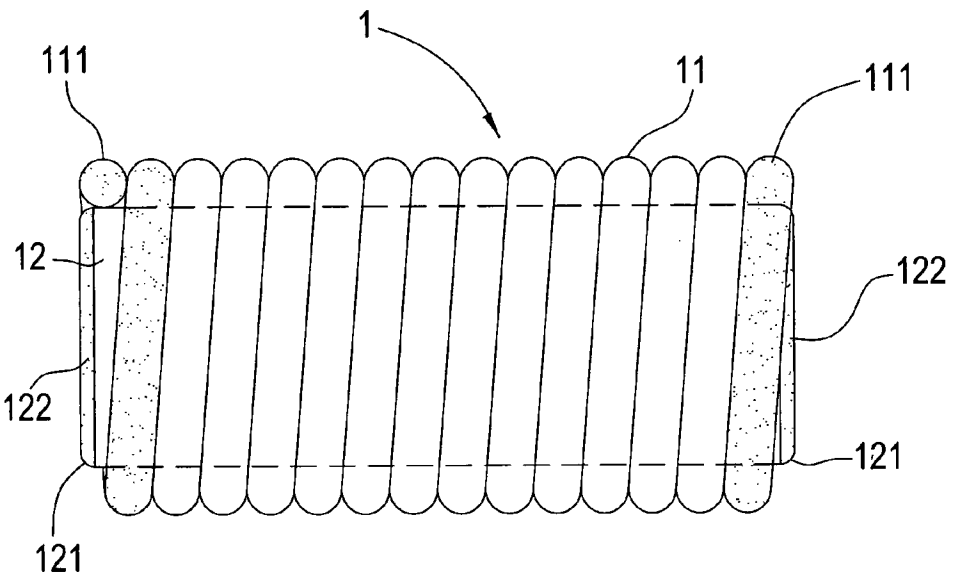
Figure 8:
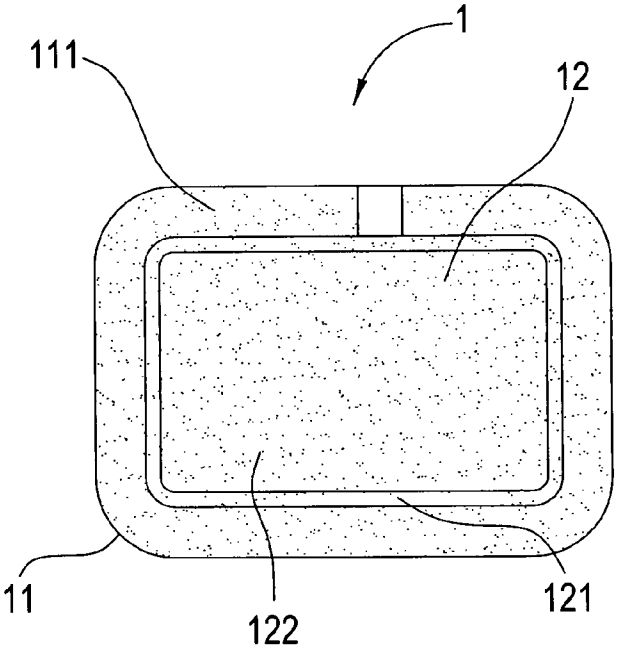
FIGS. 8 (*a*), (*b*) are schematic views of the wire wound choke coil according to the present invention in which the coil and core are configurated in a square cross section.
Figure 8:
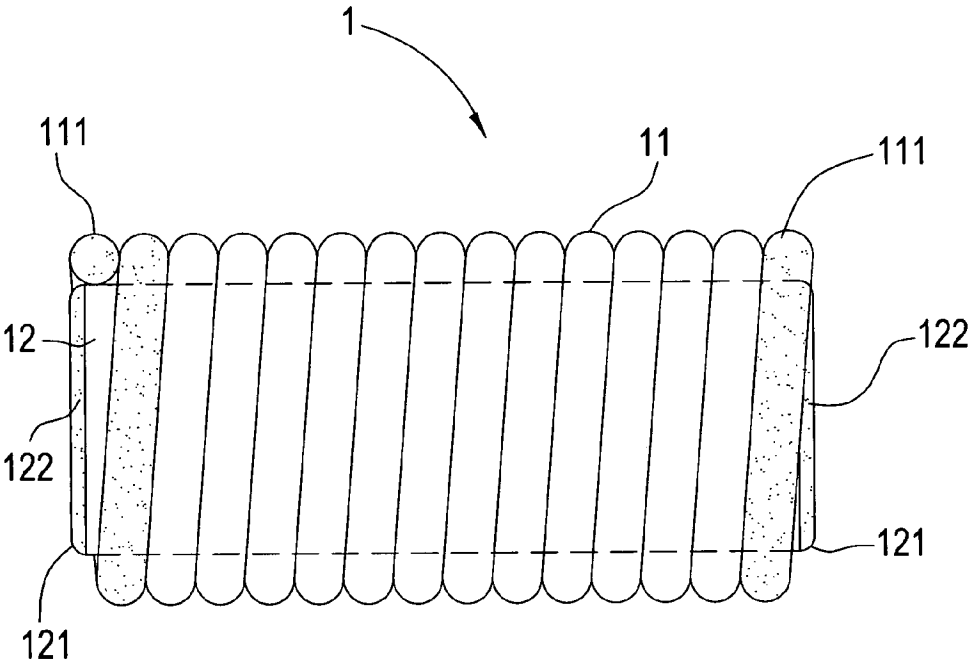

Meanwhile, for attaining the aims of compactness and thin in thickness which the electronic product of the present day needs, the devices to mount on the circuit board are also asked for smaller in size and lower in height. To achieve this object, the choke coil of the present invention configurates its transverse cross sections of coil 11 and core 12 into an ellipse (see FIGS. 7(*a*), (*b*)), a square (see FIGS. 8(*a*), (*b*)) or others.

Figure 9:
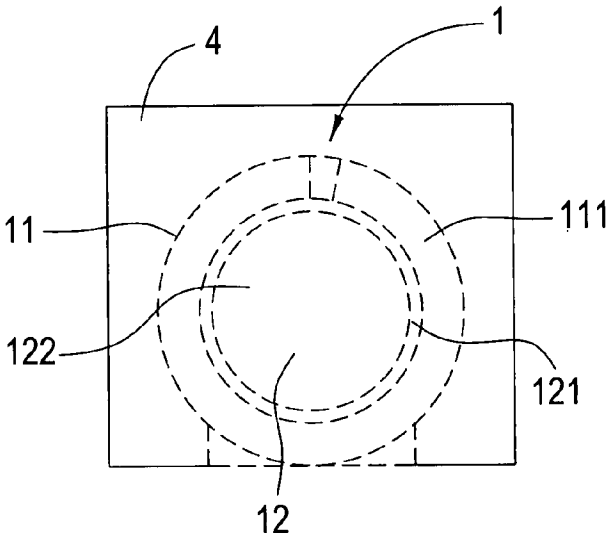
FIG. 9 to FIG. 11 are schematic views respectively a first to a third embodiment of the wire wound choke coil according to the present invention.
Figure 9:
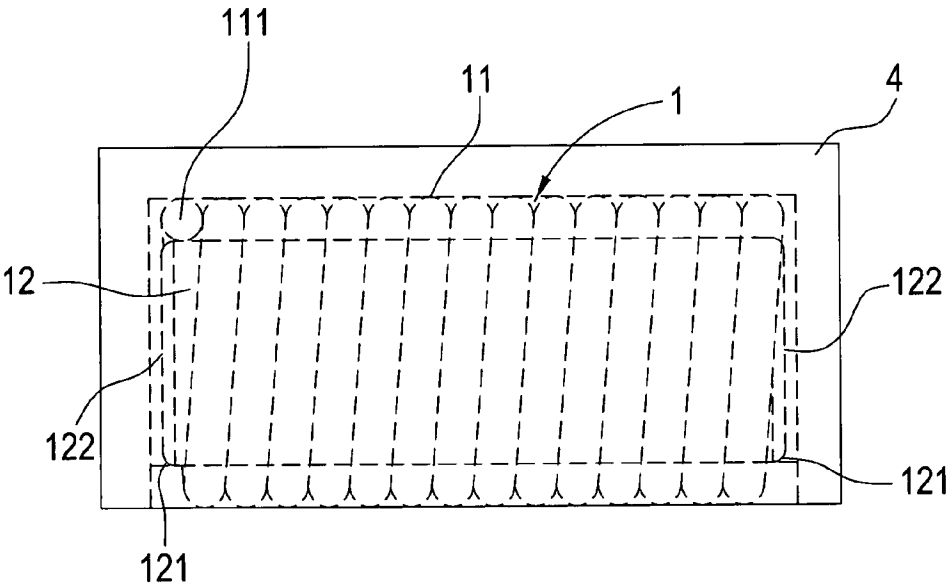
Figure 10:
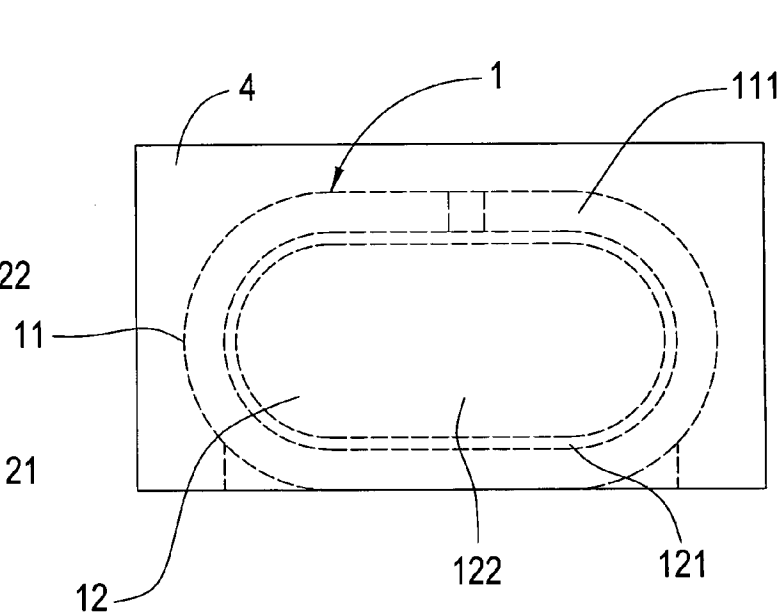
Figure 10:
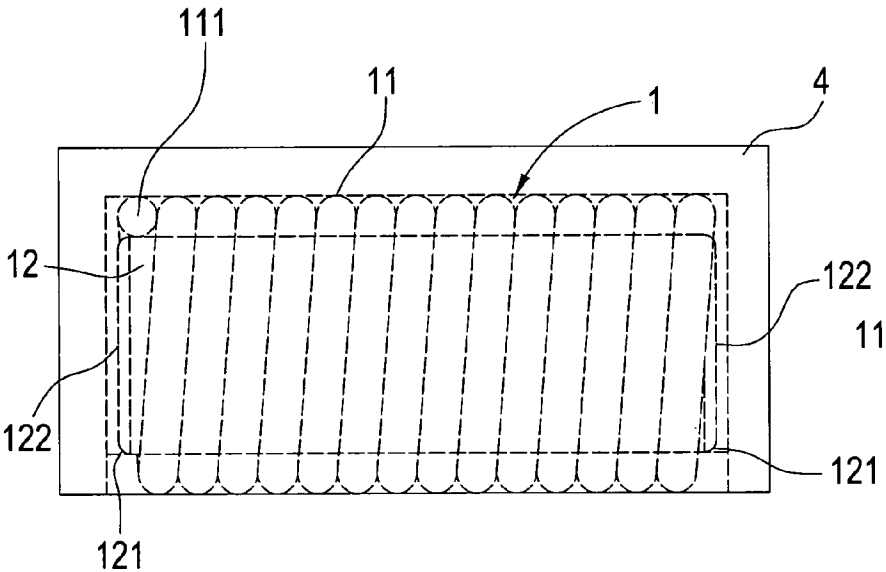
Figure 11:
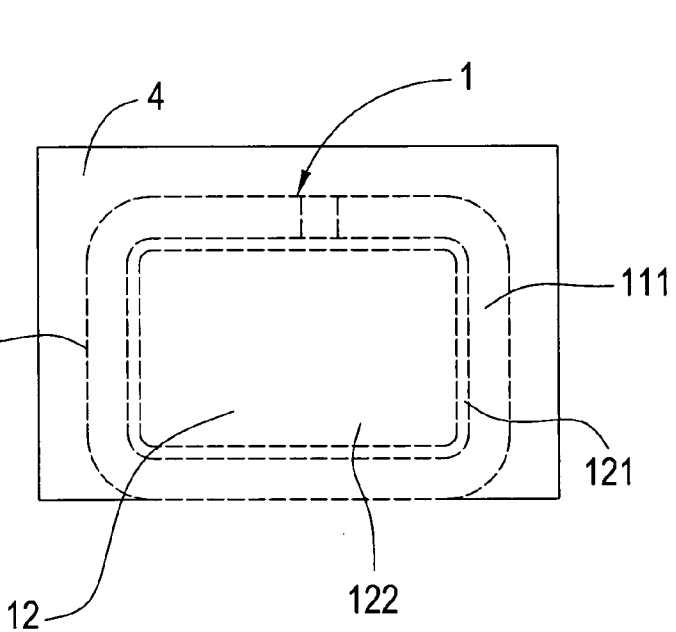
Figure 11:
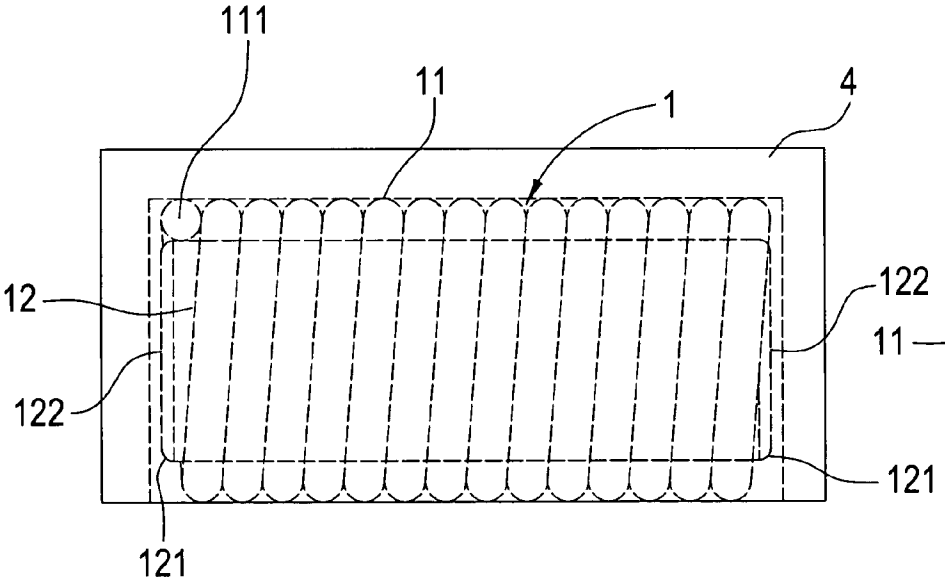

Referring to FIGS. 9(*a*), (*b*) through FIGS. 11 (*a*), (*b*), no matter whether into a round, ellipse, or squares the transverse cross section of the coil 11 and core 12 are configurated, they are all sealed with a resin 4, ferrite, or ceramic for convenience to handle.

The fabrication of the wire wound choke coil of the present invention comprises the following steps:

Electroplating a layer of gold, silver, nickel, tin or others on a metallic conductor to be used as the choke coil before enclosing an insulation film on the conductor so as to prepare an insulated electroplated conductor before forming a coil by winding, its both ends can be directly served as terminals to be connected to an electrical circuit board by soldering after stripping off the insulation film, in this version the fabrication process can be greatly shortened, production cost lowered with improved yield by eliminating the process of applying the solder or electroplating after stripping off the insulation as that performed in the prior art.

Stripping off the insulation film on the both ends and winding the insulated electroplated conductor prepared in the above step to form a coil, by leaving the stripped length slightly less than one turn so as to prepare directly solderable terminals (electrodes).

Inserting a core with two chamfered or filleted end surfaces into the coil formed in the above step, both end surfaces are pre-electroplated, the outer diameter of the core is made slightly larger than the inner diameter of the coil so that the core is firmly held by the coil with the resiliency of the coil and never parting with each other, as the two terminals of the coil and the two end surfaces of the core are pre-electroplated, they are easy for soldering to the circuit board, as both the coil and core are configured cylindrical without any protruded portion, they are easy for assembling by rotating thereby a low cost choke coil may be fabricated by automation.

Further, after inserting the core into the coil, soldering both terminals (electrodes) of the coil and both end surfaces of the core together to form a terminal and improve the solderability.

If two choke coils 1 are combined together, a Common Mode Choke Coil is obtained.

Figure 12:
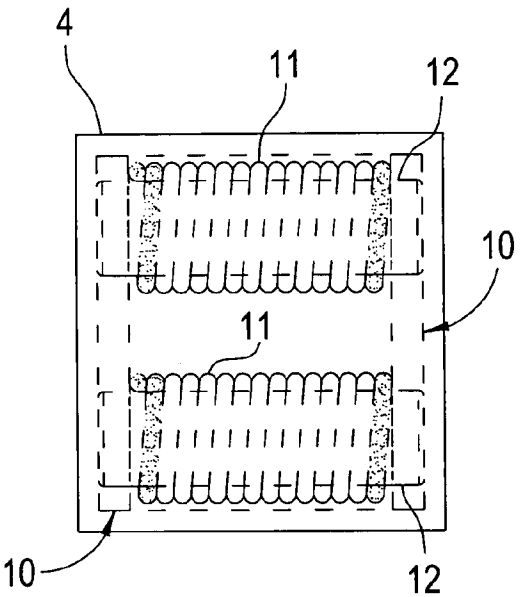
FIG. 12 to FIG. 14 are schematic views respectively a first to a third embodiment of the common mode choke coil according to the present invention.
Figure 12:
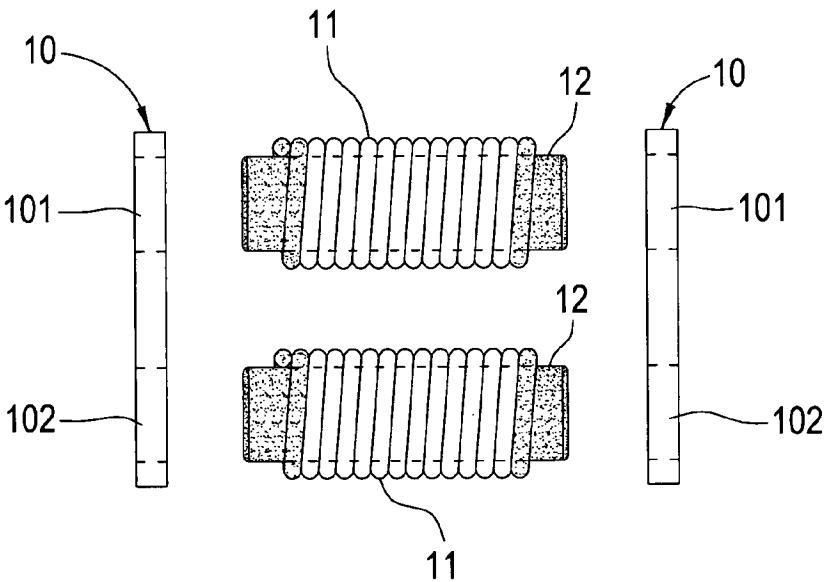

Referring to FIGS. 12 (*a*), (*b*), two units of choke coil 1 are combined to one unit of common mode choke coil using two square magnetic plates 10. The core 12 is slightly longer than coil 11 with its two ends emerged out of the coil 11. The square magnetic plate 10, which being made of the same material as core 12, is provided with a first hole 101 and a second hole 102 for engaging the protruded portions of the core 12 at both ends. After enclosing the whole structure with a resin 4, the fabrication of a common mode choke coil of the present invention is completed.

Figure 13:
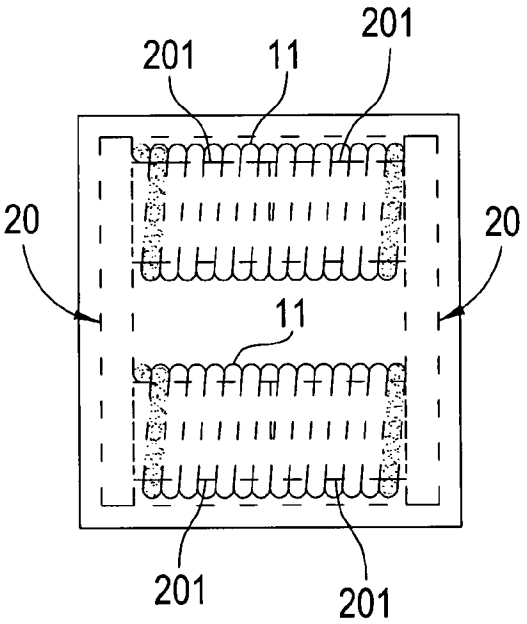
Figure 13:
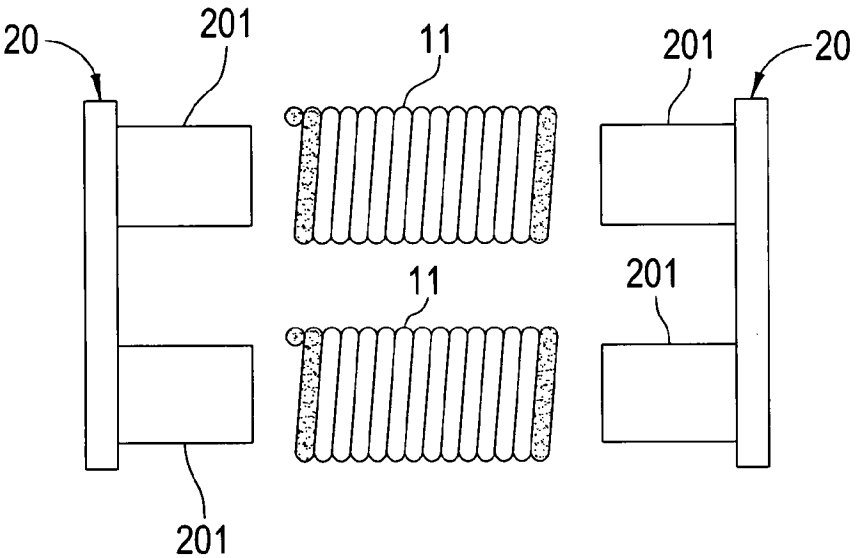

Referring to FIGS. 13(*a*), (*b*), alternatively, the two cores 12 shown in FIGS. 12(*a*), (*b*) can be replaced by two approximately U shaped magnetic elements 20 each having two magnetic cores 201. After inserting each magnetic core 201 into the corresponding coil 11 from both ends, the whole structure is enclosed with a resin 4 thereby finishing the fabrication of a common mode choke coil.

Figure 14:
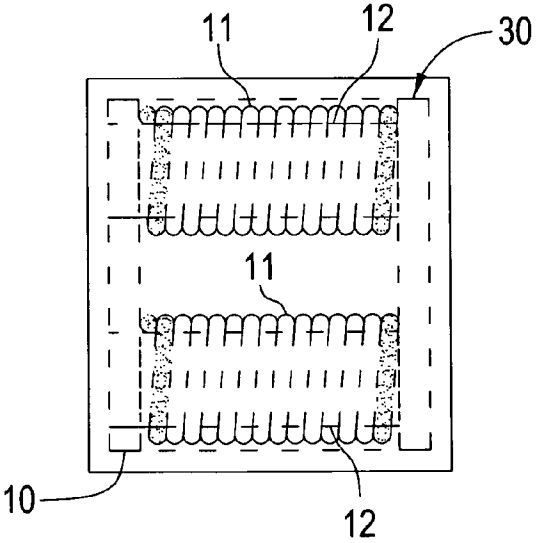
Figure 14:
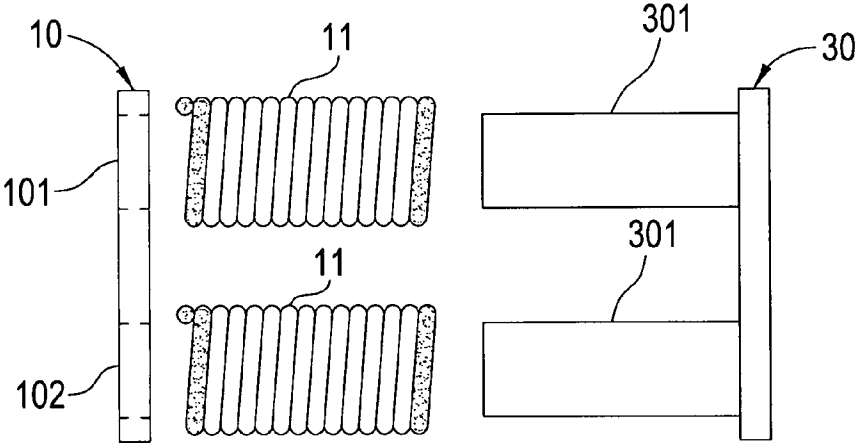

Referring to FIGS. 14(*a*), (*b*), alternatively, the two cores 12 shown in FIGS. 12(*a*), (*b*) may be replaced by one approximately U shaped magnetic element 30 provided with two magnetic cores 301. The U shaped magnetic element 30 is assembled with the two coils 11 by inserting each of its two magnetic cores 301 into the corresponding coil 11 until both tips of the magnetic cores 301 are emerged out of the opposite side of the coils 11. After the protruded tips of the two magnetic cores 301 are engaged to a square magnetic plate 10 of same material, the whole structure is enclosed with the resin 4 thereby completing the fabrication of a common mode choke coil.

In order to eliminate complicated design when designing a LC filter circuit, and minimizing the size of the circuit board also easy design, the choke coil provided by the present invention can be accompanied with a capacitor in one package so as to form a SMD filter applicable to various frequency band-width and rated voltage, rated current. However, for serving the user with a low cost selection, the land pattern on the circuit board is designed in the version that it can be applicable to both packaged or a separated type by only changing solder mask.

The packaged filter can be used for better appearance and more convenience. However, the choke coil of the invention and other accompanied components can be used for a lower cost.

Figure 15:
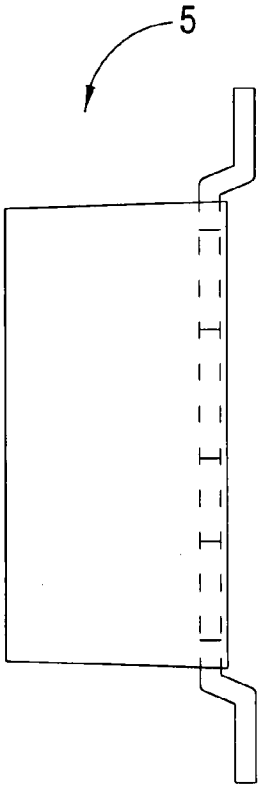
FIG. 15 and FIG. 16 are schematic views of the wire wound choke coil with different type of land patterns on the circuit board.
Figure 15:
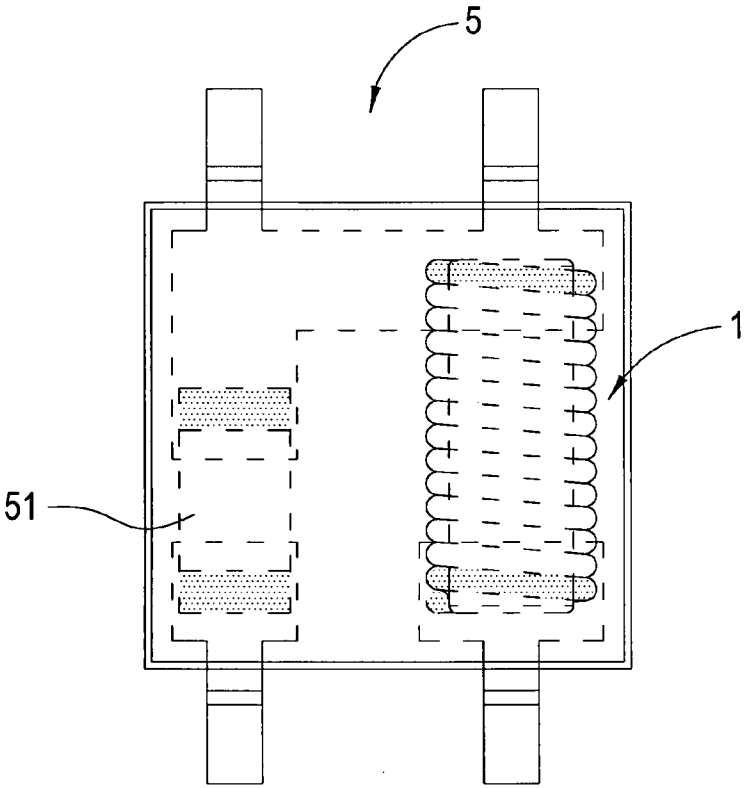
Figure 16:
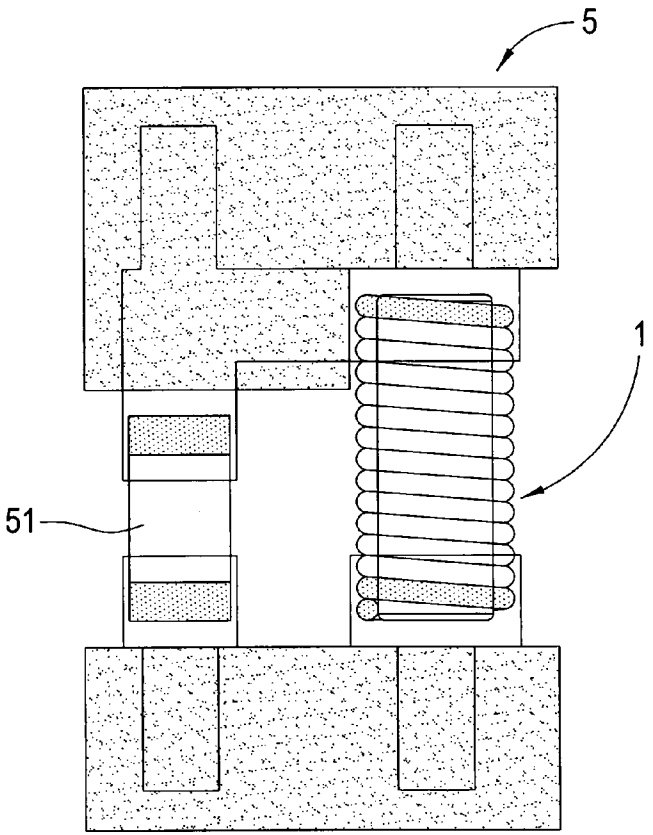
Figure 16:
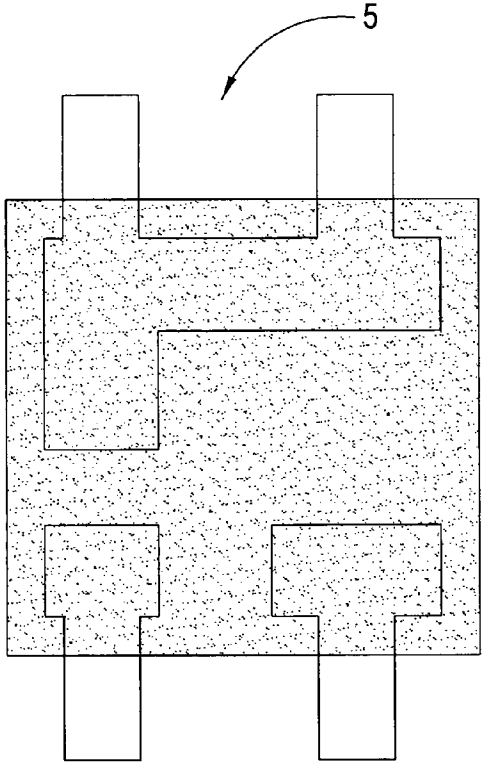

Referring to FIGS. 15(*a*), (*b*), the choke coil 1 and a capacitor 51 are packed together to form a L type filter 5, its land pattern on the circuit board is shown in FIG. 16(*a*). As shown in FIG. 16(*b*), on the basis of a same land pattern but different solder mask, the choke coil 1 and the capacitor 51 can be mounted on the same circuit board so as to cut down extra cost for packaging, which provides the users not only better appearance and convenience (packaged filter), but also decrease the cost (separated type). This principle is not only applicable to a L type filter, but also to those π type and T type filters composed of a plurality of components.

In all, the wire wound choke coil according to the present invention has several noteworthy advantages compared to that provided by the prior art:

1. The fabrication process is simplified, mass production by low cost is possible.

2. As the coil is wound with an electroplated conductor with an insulation film, its terminals do not need to be soldered or plated for connection after stripping off the insulation.

3. Only a length of slightly less than one turn needed to left at each conductor end for termination saves the labor for stripping insulation.

4. A cylindrical configuration of both coil and core facilitate fabrication and assembly by automation.

Many changes and modifications in the above-described embodiments of the invention can, of course, be carried out without departing from the scope thereof. Accordingly, to promote the progress in science and the useful arts, the inventions disclosed and intended to be limited by the scope of the appended claims.

What is claimed is:

1. A wire wound choke coil comprising:

a coil made of an insulated pre-plated conductor which is pre-plated with a layer of metal before covering with an insulation film and wound closely or loosely with a predetermined number of turns and inner diameter, and extending both terminals with a length slightly less than one turn; and a core with two chamfered or filleted end surfaces at both ends, being inserted longitudinally into an inner hollow cavity of the coil and forcibly embraced by the coil with a resiliency thereof without worry of parting.

2. The choke coil of claim 1, wherein the conductor of the coil is electroplated with the layer of metal selected from gold, silver and nickel.

3. The choke coil of claim 1, wherein the coil is formed of a twisted insulated conductors for large current use.

4. The choke coil of claim 1, wherein the coil is formed into a multi-layered coil by repeatedly winding back and forth with the same conductor, or with different kinds and sized insulated conductors.

5. The choke coil of claim 1, wherein the core is formed of material selected one from ferrite, ceramic and glass.

6. The choke coil of claim 1, wherein a transverse cross section of the coil and the core are configurated into an ellipse or a square.

7. The choke coil of claim 1, wherein the coil and the core are enclosed with resin, ferrite or ceramic for sealing.

8. A wire wound choke coil comprising:

a coil made of an insulated pre-plated conductor which is pre-plated with a layer of metal before covering with an insulation film and wound closely or loosely with a predetermined number of turns and inner diameter, and extending both terminals with a length slightly less than one turn; and a core with merely two chamfered or filleted end surfaces being pre-plated with a layer of metal plating, the coil being able to embrace the core forcibly with a resiliency thereof without parting when the core being inserted into the hollow inner cavity of the coil.

9. The choke coil of claim 8, wherein the conductor of the coil is electroplated with one metal selected from gold, silver, tin, and nickel.

10. The choke coil of claim 8, wherein the coil is formed of a twisted insulated conductors for large current use.

11. The choke coil of claim 8, wherein the coil is formed into a multi-layered coil by repeatedly winding back and forth with the same conductor, or with different kinds and sized insulation conduction.

12. The choke coil of claim 8, wherein both terminals of the coil and both end surfaces of the core are soldered together as one terminal so as to improve solderability.

13. The choke coil of claim 8, wherein the core is formed of the material selected one from ceramic and glass.

14. The choke coil of claim 8, wherein the core is slightly longer than the coil by emerging out of the coil, wherein both protruded portions thereof are electroplated.

15. The choke coil of claim 8, wherein each of the protruded portions of the core is respectively shackled with a pre-plated square hollow metal conductor so as to carry out soldering work stably.

16. The choke coil of claim 8, wherein a transverse cross section of the coil and the core are configurated into an ellipse or a square.

17. The choke coil of claim 8, wherein the coil and the core are enclosed with resin, ferrite or ceramic for sealing.

* * * * *